US006868575B2

(12) United States Patent
Koregelos

(10) Patent No.: US 6,868,575 B2
(45) Date of Patent: Mar. 22, 2005

(54) CLEANING DEVICE

(76) Inventor: George Koregelos, 470 Mountain Ave., Piedmont, CA (US) 94611

( * ) Notice: Subject to any disclaimer, the term of this patent is extended or adjusted under 35 U.S.C. 154(b) by 204 days.

(21) Appl. No.: 10/072,675

(22) Filed: Feb. 8, 2002

(65) Prior Publication Data

US 2002/0108196 A1 Aug. 15, 2002

Related U.S. Application Data

(63) Continuation-in-part of application No. 09/494,866, filed on Jan. 31, 2000, now abandoned.

(51) Int. Cl.[7] ..... B08B 9/023; B08B 9/055; B08B 9/04

(52) U.S. Cl. ..... 15/104.04; 15/104.061; 15/104.2; 15/164

(58) Field of Search ..... 15/104.04, 104.061, 15/104.16, 104.2, 154

(56) References Cited

U.S. PATENT DOCUMENTS

| | | | | |
|---|---|---|---|---|
| 818,497 | A | 4/1906 | Wittemore | 15/207 |
| 1,337,173 | A | 4/1920 | White | 15/176.1 |
| 1,421,529 | A | 7/1922 | Millhouse | 15/160 |
| 1,454,191 | A | 5/1923 | Stebler | 15/182 |
| 1,596,422 | A | 8/1926 | Fulton | 277/355 |
| 1,967,783 | A | 7/1934 | Rudof | 300/21 |
| 2,363,217 | A | 11/1944 | Woodling | 300/21 |
| 2,513,719 | A | 7/1950 | Glass | 15/206 |
| 2,609,242 | A | 9/1952 | Nelson | 300/21 |
| 2,690,569 | A | 10/1954 | Kozerski | 4/292 |
| 2,704,854 | A | 3/1955 | Peterson | 15/182 |
| 2,727,267 | A | 12/1955 | Osgood | 15/182 |
| 2,756,109 | A | 7/1956 | Nelson et al. | 300/2 |
| 2,768,402 | A | 10/1956 | Back | 15/164 |
| 2,839,771 | A | 6/1958 | Hunter | 15/164 |
| 3,085,272 | A | 4/1963 | Weichselbaum | 15/164 |
| 3,343,884 | A | 9/1967 | Hunt | 300/21 |
| 3,351,387 | A | 11/1967 | Lechene | 300/21 |
| 3,604,043 | A | 9/1971 | Lewis, Jr. | 15/159.1 |
| 3,633,974 | A | 1/1972 | Lewis, Jr. | 300/21 |
| 3,768,109 | A | 10/1973 | Wardell | 15/88.3 |
| 3,798,699 | A | 3/1974 | Lewis, Jr. | 15/179 |
| 4,176,419 | A | 12/1979 | MacDonald | 15/1.7 |
| 4,189,189 | A | 2/1980 | Lewis, Jr. | 300/7 |
| 4,302,494 | A | 11/1981 | Horton | 428/93 |
| 4,449,266 | A | 5/1984 | Northemann et al. | 15/167.2 |
| 5,222,268 | A | 6/1993 | Snodgrass | 15/29 |
| 5,511,274 | A | 4/1996 | Lewis, Jr. | 15/160 |
| 5,515,569 | A | 5/1996 | Montabaur et al. | 15/160 |
| 5,819,357 | A | 10/1998 | Gould | 15/182 |
| 5,972,125 | A | 10/1999 | Hedge | 134/8 |

FOREIGN PATENT DOCUMENTS

| | | |
|---|---|---|
| DK | 15685 | 3/1912 |
| GB | 1094756 | 12/1967 |
| JP | 02 286120 A | 11/1990 |
| JP | 03 126445 A | 5/1991 |
| JP | 04 241805 A | 8/1992 |

*Primary Examiner*—Mark Spisich
(74) *Attorney, Agent, or Firm*—James R. Cypher; Charles R. Cypher

(57) ABSTRACT

A cleaning device and method for making which is constructed from a flexible base member of thermoplastic material to which a plurality of fibers are fused and protrude therefrom, and formed into a curvilinear configuration such as a helix-like, or U-shaped-like configuration. The method includes the steps of heating the base until it is softened and bent to a U-shape like configuration and then cooling the base member, or helically winding the base onto a rotating mandrel; stopping the mandrel and severing an end of the base member; and cooling the base member so that it retains its U-shape or helical configuration. A core member may also be inserted through the opening in the helix-like configuration and attached at one or more points of the base member permitting the cleaning device to be pushed through tubular members.

21 Claims, 13 Drawing Sheets

CLEANING DEVICE

This application is a continuation-in-part of application Ser. No. 09/494,866 filed Jan. 31, 2000 voluntarily abandoned Feb. 9, 2002 after filing this application.

This invention is specifically constructed for cleaning the slide valves of all brass section musical instruments, but may also be used in cleaning all types of tubular devices from the glassware in chemistry labs and other industrial and commercial uses to kitchenware used in food preparation.

BACKGROUND OF THE INVENTION

Musical instruments in the brass section such as the trumpet, French horn, flugelhorn, cornet, mellophone, baritone horn, euphonium, tuba, sousaphone and trombone , all of which have removable slides, must be cleaned periodically. Brushes have been developed and are available commercially for this task. All of these brushes are constructed from straight fibers or bristles which are mechanically bound to a pair of twisted metal wires which are flexible to some extent. The problem with such metal wires is the fact that if the plastic or rubber caps are separated from the ends of the wires, the sharp edged wire ends can scratch or actually punch through the soft brass , thin wall metal tubes of the musical instruments, particularly those which have sharp, small diameter turns. Twisted wire brushes are not particularly flexible and this further exacerbates the scrapping and scratching of the interior walls of the instruments. Many slides in musical instruments are formed with 180° turns and damage to the geometry of the slide can take place in the hands of a careless or young amateur musician.

Musical instruments and heat exchangers as well as laboratory glass ware are constructed with a wide range of lengths and diameters. A universal brush made from twisted wire is simply not available. to handle the different diameters and different lengths. Many brushes, in an attempt to accommodate different lengths merely have fibers at the end of a very long handle. If the brush needs to be pushed through a sharp bend which occurs at the mid portion of the instrument, heat exchanger or glass ware the portion of the brush not covered with fibers must be covered with a soft flexible sheath to protect the inner wall of the metal or glass tube from the much harder surface of the twisted wire brush.

SUMMARY OF THE INVENTION

The gist of the present invention is a cleaning device which contains no metal parts and has no part with a hardness greater than the object being cleaned. Thus scratching, abrading or otherwise damaging materials in the cleaning device are eliminated to protect the musical instruments, laboratory glass ware, houseware or other objects being cleaned.

An object of the present invention is to provide an inexpensive, easy to use cleaning device which is inexpensive to manufacture, can be used to clean objects having internal passageways of varying lengths, opening sizes and angular turns, yet can be easily modified and manufactured in different shapes, lengths and diameters to accommodate an even wider variety of objects to be cleaned.

A further object is to provide a cleaning device which has no core or shaft so that the basic structure can be easily modified so that cleaning devices can be made to clean the internal walls of a tube as well as the outer circumference of the tube.

Still a further object is to provide a cleaning device which has the inherent ability to stretch automatically to reduce its diameter when inserted through a constricted opening or pulled through a sharp bend in a tubular member. This feature enables the diameter of the cleaning device to be reduced without bending the fibers of the cleaning device under some situations and bending the fibers less in other situations.

Yet another object is to provide a cleaning device with the inherent ability to increase its diameter when moving from a constricted portion of a tube to a wider portion of the tube yet maintain the cleaning fibers in a relatively right angular relationship to the inside wall of the tube being cleaned.

Still another object is to provide a method for constructing a cleaning device which can be manufactured in a variety of shapes, a variety of configurations, and sizes from the same base element.

Another object is to provide a cleaning device made from the previously described base which is attached to a core member which is dimensioned and configured so that it will not buckle for the particular object to be cleansed as it is pushed through the tubular member which may or may not have openings at both ends.

Another object is to provide leaders at one or both ends of the cleaning device so that the cleaning device may be pushed, drawn or even moved in a reciprocating manner as in "sawing" to enable the cleaning function.

DETAILED DESCRIPTION OF THE PREFERRED EMBODIMENTS

The cleaning device 1 of the present invention consists briefly of a base member 2, a plurality of fibers 3 integrally connected to the base member 2 and protruding therefrom, the base member 2 has an elongated helix-like configuration 4.

Figure 5:
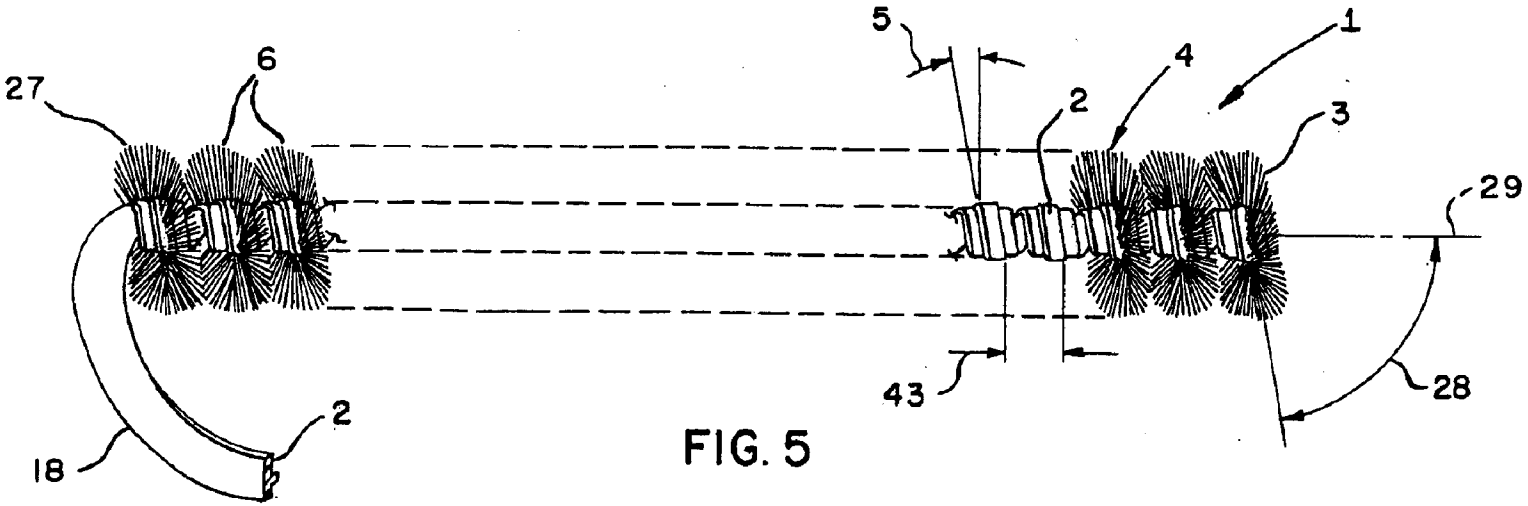
FIG. 5 is side view of the article of the present invention, partially in perspective format and with portions in dashed lines which are merely repetitive. Portions are cut away to show the configuration of the base member.
Figure 6:
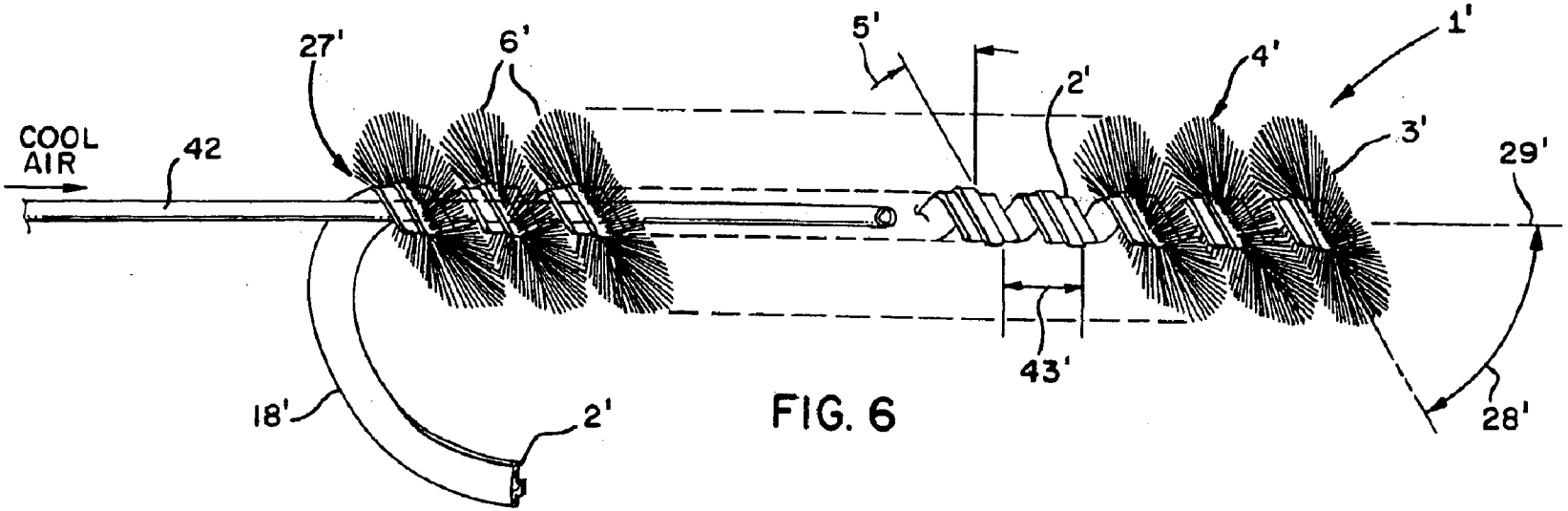
FIG. 6 is a side view of an alternate article form of the invention, partially in perspective format and with portions in dashed lines which are merely repetitive. Portions are cut away to show the configuration of the base member.

In the preferred form of the cleaning device, as best shown in FIGS. 5 and 6, base member 2 has an elongated helix configuration.

In one form of the invention, the base member 2 has an elongated helix-like configuration 4 having a constant helical angle 5 as shown in FIG. 5.

In another form of the cleaning device, the base member 2 has an elongated helix-like configuration having a varying helical angle.

Figure 7:
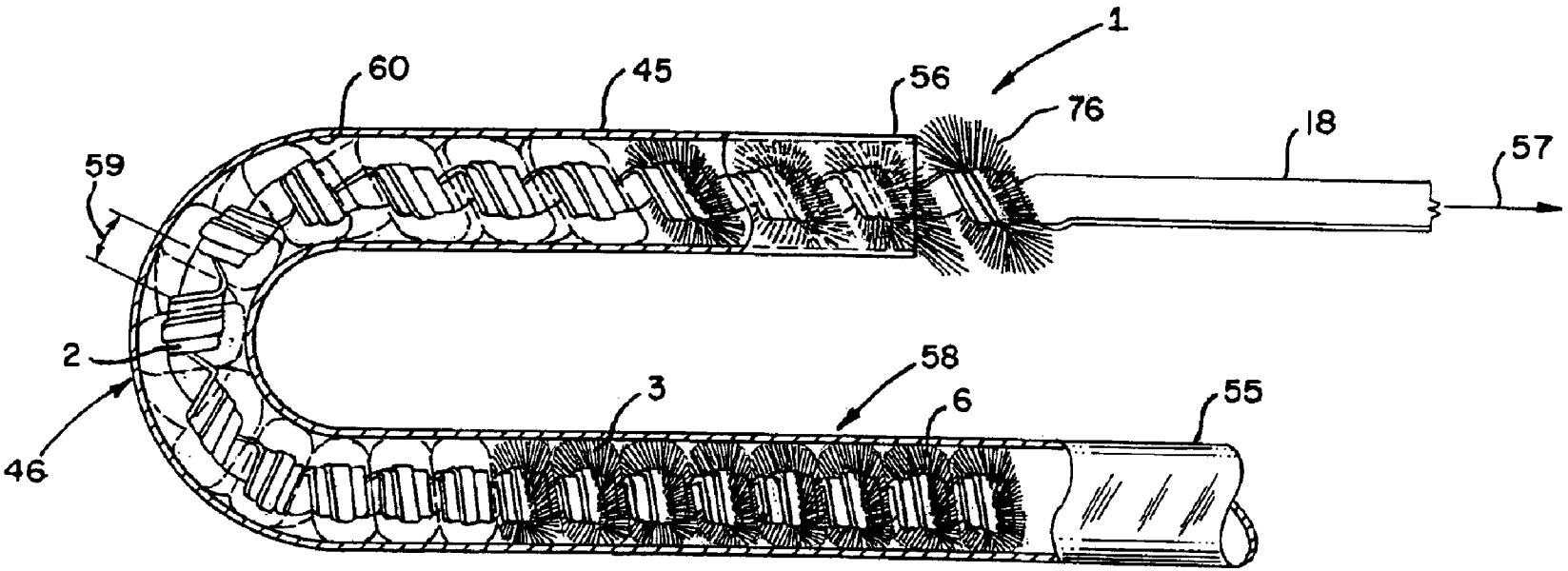
FIG. 7 is side view of the cleaning device illustrated in FIG. 5 showing the different configurations the cleaning device takes in the operation of being pulled through a tube with portions cut away for purposes of illustration.

In still another form of the cleaning device 1 as shown in FIGS. 5 and 7, the cleaning device has a base member 2 with an elongated helix-like configuration 4 having a selected helical angle 5 which forms a cleaning device with coils 6 which are close fitting one to the other.

In another form of the cleaning device, as illustrated in FIG. 6, the base member 2' has an elongated helix-like configuration 4' having a selected helical angle 5' which forms a device with coils 6' which are spaced one from the other a selected distance 43' greater than the distance 43 in FIG. 5.

In still another form of the cleaning device, the fibers protrude from the base member 2 at varying selected lengths from the base member 2.

In another form of the cleaning device, base member 2 has an elongated helix-like configuration 4 having a constant selected helical angle 5.

In a further form of the cleaning device, base member 2 has an elongated helix-like configuration 4 having varying selected helical angles 5.

In another preferred form of the invention base member 2 is formed from a thermoplastic spring memory return material.

Figures 1, 4:
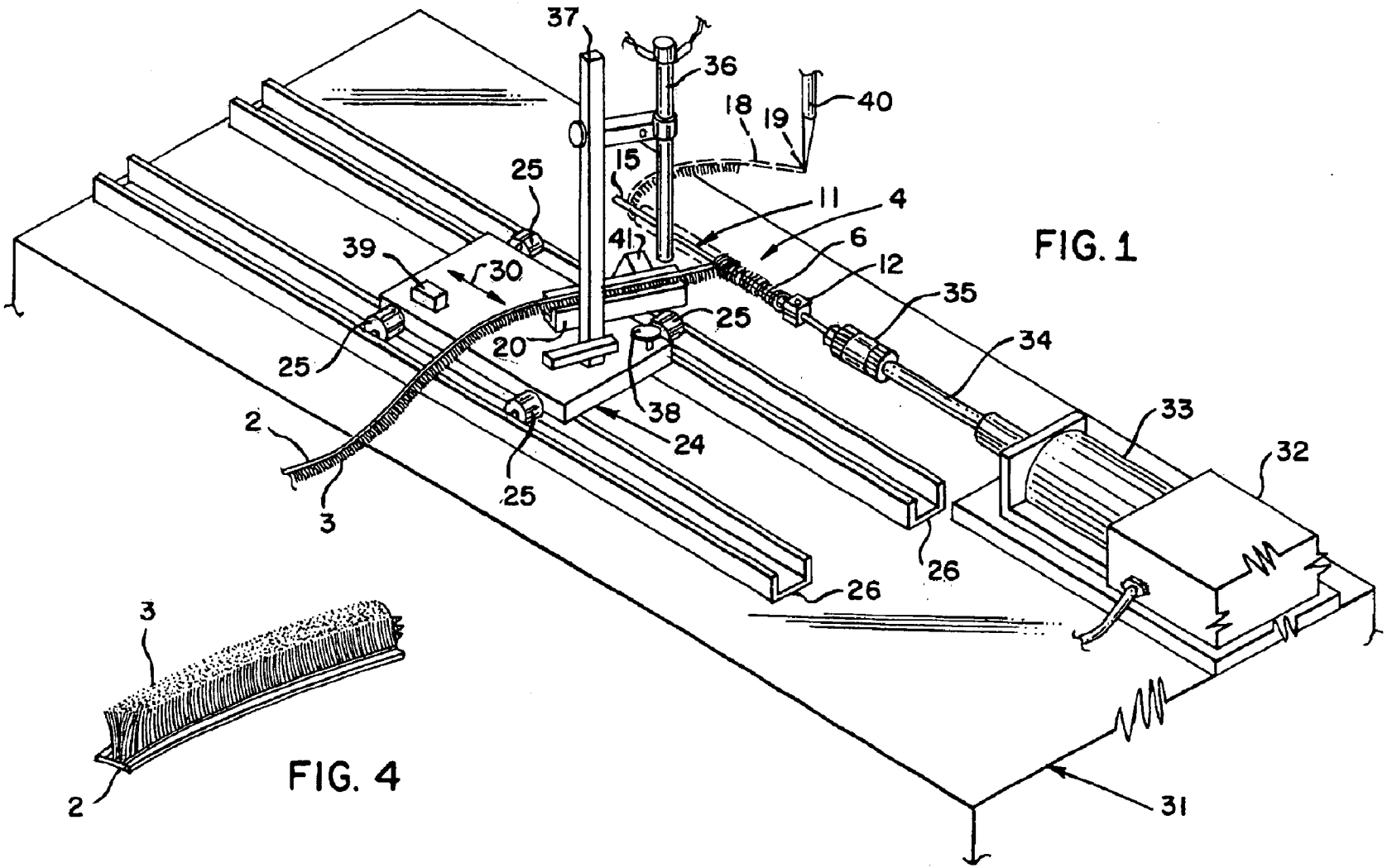
FIG. 1 is a schematic perspective view of a simplified version illustrating a method of constructing a cleaning device of the present invention.
FIG. 4 is a perspective view of a portion of one of the elements in constructing the cleaning device of the present invention.

As shown in FIG. 4 the basic building element of the cleaning device of the present invention is simply a strip of thermoplastic material 2 such as polypropylene with fibers 3 of the same material fused to the base 2. By fusing the filaments 3 to the base 2, the fibers cannot separate from the base unless they are actually severed. One of the sources of the base 2 and fibers 3 is a product made by a number of manufacturers for several years which is primarily used as insulation material in a number of industries. The product is thermoplastic and when its specific softening temperature has been reached it can be easily wound on a mandrel 11. When the base 2 is cooled, the base 2 assumes the same configuration as the mandrel 11. The product is preferably a spring memory material so that when wound in a helix and force applied at opposite ends, the helix will elongate. When the force is released, the helix returns to its former length and diameter.

Preferably a polypropylene ball is fused to the end 19 of the leader 18 and to the other end of the base member 2 to guide the leader past "catch points" in the tube.

DESCRIPTION OF AN APPARATUS FOR PRACTICING A METHOD OF THE PRESENT INVENTION

Figure 2:
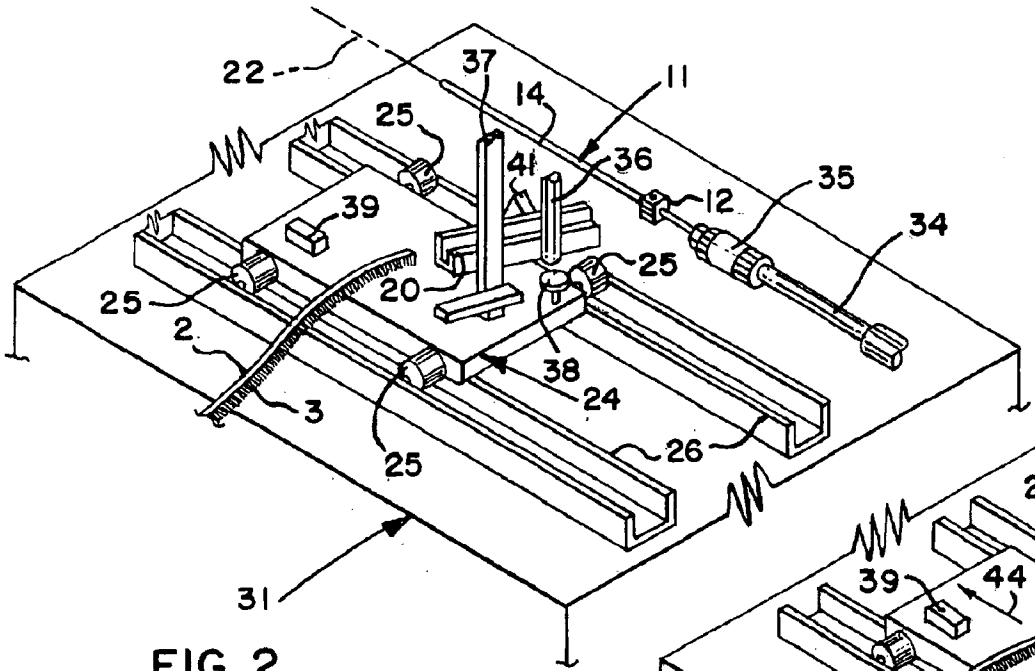
FIG. 2 is schematic perspective view of a portion of the apparatus disclosed in FIG. 1 illustrating one of the steps in the method of the present invention.
Figure 3:
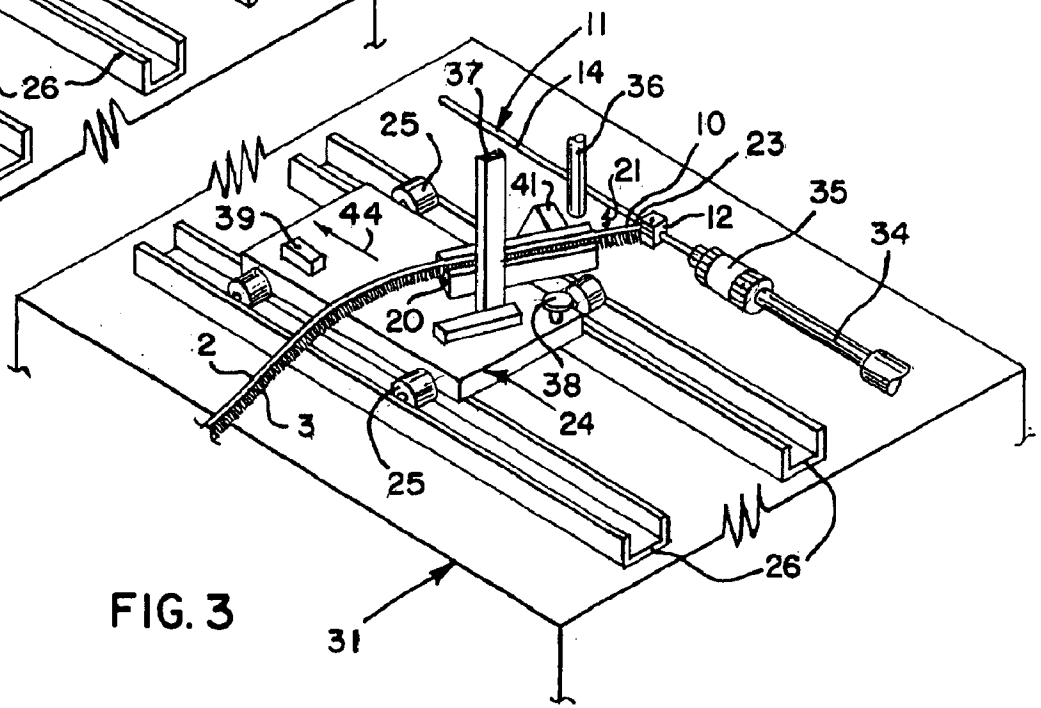
FIG. 3 is a schematic perspective view illustrating another position of the apparatus shown in FIG. 2 further illustrating another step in the method of the present invention.

FIGS. 1, 2 and 3 illustrate an apparatus for practicing a method of the present invention. The drawings are schematic and illustrate a simplified form of the apparatus for purposes of understanding the method. Various changes and improvements are contemplated for increasing the mass production of the cleaning device 1.

A platform 31 is provided and affixed thereto is a speed controller 32 which controls the speed of a motor 33 which turns a drive shaft 34 connected to a chuck 35 for releasably gripping mandrels 11 of varying size. A gripping member 12 for gripping the end of base member 2 is attached to and rotates with the mandrel 11. A guide 20 is pivotally mounted on a carriage 24 for guiding the base member 2 therethrough at a selected angle 21 in relation to the axis 22 of mandrel 11. Preferably the base member 2 enters the guide member 20 with the fibers 3 directed downwardly so that hot air from a heat tube 36 will be directed upon the base member 2. The heat tube 36 is preferably mounted on a swivel device 37 so that when no base member 2 is being fed through the guide member 20, the heat may be directed onto a thermal device 38 which measures the temperature and signals when the temperature is hot enough to begin the operation of the device. A speed controller 39 may be provided to control the velocity by which the carriage 24 traverses the platform 31 in tracks 26. A shear device 40 severs the base member 2 at leader end 19. An angle controller 41 pivots guide 20 at selected angles to feed the base member 2 at varying angles 21 to the axis 22 of the mandrel 11. When the cleaning device has received the selected number of coils 6, The rotation of mandrel 11 is stopped and cooling air is directed against the heated base member 2 through a cooling tube 42 or other cooling means. If the mandrel 11 is hollow, the cooling tube 42 may be placed through the mandrel.

Method of Manufacture

The various cleaning devices of the present invention may be made using a method which includes the steps of: selecting an elongated base member 2 formed from a thermoplastic material and having a plurality of fibers 3 integrally connected thereto and protruding therefrom; attaching a first portion 10 of the base member 2 as shown in FIG. 3 by means of gripping member 12 to a rotatable mandrel member 11 at a starting point 23 on the mandrel 11; simultaneously rotating the mandrel 11, and progressively feeding the base member 2 onto the mandrel 11 at an ever increasing distance from the starting point 23 on the mandrel 11; applying sufficient heat to the base member 2 to soften the thermoplastic material so that it will conform to the outer surface 14 of the mandrel 11; continuing the rotating and feeding steps until a selected end point 15 away from the starting point 23 on the mandrel 11 is reached; applying a cooling medium to the base member 2 until the base member 2 hardens and remains conformed to the outer surface 14 of the mandrel 11; and removing the base member 2 from the mandrel 11.

In the preferred form of making the cleaning device 1, the method of manufacture includes selecting a base member 2 wherein the fibers 3 protrude from one side only of the elongated base member 2; and feeding the base member 2 onto the mandrel 11 as previously described so that the base member 2 is fed onto the outer surface 14 of the mandrel 11 so that the fibers 3 protrude radially outwardly from the mandrel 11.

In another method for forming a cleaning device, a base member 2 is selected wherein the fibers protrude from one side only of the elongated base member 2. A mandrel having a tubular configuration having an inside wall is selected. The base member 2 is releasably attached to a clamp member or other attachment member on a mandrel. As the mandrel is rotated, the base member 2 is fed into the mandrel tube so that the fibers 3 protrude radially inwardly from the inside wall of the mandrel tube. Using this method of construction, a cleaning device is formed which is useful in cleaning the outer circumference of tubes. Such a situation may exist where the tube is located within a tube and it is difficult to clean the outer surface of the tube with standard cleaning devices. The device may also be used in cleaning the outside surfaces of glass drinking containers or other tubular housewares.

The preferred method for forming the cleaning device 1 of the present invention, is to apply the heat for softening the base member 2 prior to the step of feeding the base member 2 onto the mandrel 11 as shown in FIGS. 1 and 3. Other methods as previously indicated could include feeding the base member 2 in its unaltered state onto a mandrel 11 which is preheated, or heated during the feeding step. The method of heating may include impinging hot gases on the mandrel, applying ultrasound waves, or charging the mandrel with an electric current.

Another method of making an alternate form of the cleaning device is to follow the steps of making the cleaning device as previously described. Then, after a selected number of coils 6 of the device have been wound upon the mandrel 11, the rotation of the mandrel 11 is stopped and instead of severing the base member 2 at or near the last coil 6 , the base member 2 is severed at a selected distance from the last portion of the base member 2 which was fed upon the mandrel. In this manner a leader member 18 is provided which can be used to feed through a tubular member 45 and once the leader end 19 emerges from the tube 45, as shown in FIG. 7, the remainder of the cleaning device 1 can be pulled through the tube which is generally much easier than pushing the cleaning device through the tubular member 45, particularly where, as in the illustration in FIG. 7, the tube 45 makes a 180° turn at portion 46.

The cleaning device 1 of the present invention could be entirely hand fed onto the mandrel 11, but preferably, a guide 20 is provided so that the base member 2 can be fed onto the mandrel 11 at a specific angle of rotation at a specific angle 21 in relation to the longitudinal axis 22 of the mandrel as shown in FIG. 3.

The cleaning device 1 may also be formed by hand by feeding the base member 2 onto the rotating mandrel 11 so that the base member 2 enters upon the mandrel 11 at a progressively greater distance axially from the point 23 the base member 2 initially entered upon the mandrel 11. In order to make the cleaning device 1 in a more uniform manner with the coils 6 of the cleaning device 1 spaced one from the other at either a uniform distance or a progressively greater or a progressively less distance, a carriage means 24 as shown in FIGS. 1, 2, and 3 is provided for carrying the guide member 20. The carriage means 24 could be provided with wheels 25 which run along a track 26 or any other sliding mechanism. Generally the carriage means 24 is moved at a selected velocity during the feeding step. Carriage means 24 is moved back and forth in the direction of double arrows 30 as shown in FIG. 1. When the base 2 is being fed onto mandrel 11, the carriage is moved in the direction of arrow 44 illustrated in FIG. 3.

To make cleaning devices 1 which have coils 6 which vary in distance one from the other, a speed controller 39 for varying the velocity of the carriage 24 during the feeding step may be provided. Thus a cleaning device 1 may be constructed which has coils 6 widely spaced at the entering portion of the cleaning device 1 so that the entering portion of the cleaning device exerts less pressure upon the inner walls of the tube and thus less resistance to the cleaning device 1 passing through the tube to be cleaned would be encountered. After the leader 18 has passed through the tube to be cleaned, the portion of the cleaning device with more densely packed coils enters the tube. The increased resistance to passage through the tube may be overcome by pulling the cleaning device 1 through the tube by grasping the leader member 18.

Another form of cleaning device 1'; may be constructed in which the plane of each coil 6' may be varied in relation to the longitudinal axis 29' of the cleaning device 1'. As shown in FIG. 6, angle 5' is greater than angle 5 as shown in FIG. 5. This causes the coils 6' to have a greater angle 28' in relation to longitudinal axis 29' of the cleaning device 1' than angle 28 in relation to longitudinal axis 29 in FIG. 5. One advantage of this form of the invention is that as the angle of the coils increases, the distance between the coils increases. This reduces the quantity of fiber touching the surface to be cleaned which is one method for reducing resistance, which is an advantage in some applications.

Still another form of cleaning device 1 may be constructed in which the angle 21 at which the base 2 is fed to the mandrel 11 is varied during the feeding operation. Thus the angle 5 made by the base 2 to the longitudinal axis 29 of the cleaning device 1 will vary. Coils 6 of some portion of the cleaning device 1 will be at a greater angle 5 than coils 6 at a different portion of the cleaning device 1. For example, to make it easier for the cleaning device 1 to enter a tube to be cleaned, the angle 5 of the coil 6 relative to the longitudinal axis 29 may be greater than the angle of the coils relative to the longitudinal axis 29 on the trailing end of the cleaning device 1. This duality of coil angles 5 is used in some specialized wood screws where the screw has a greater thread angle at the pointed end to enable the point to quickly enter the wood member and then after the screw enters the wood the thread angle decreases. This dual thread angle is unknown in the tube cleaning device industry. With such a dual angle cleaning device, and with the greater angled coils occurring at the lead end, it is easier for the cleaning device to enter a tube with a small diameter.

In most instances it is desirable to provide the cleaning device with a leader 18 adjacent lead coil 27 which is devoid of fibers 3. Accordingly, after the selected number of coils 6 of the base member 2 and fibers 3 are formed on the mandrel 11, the rotation is stopped, the base member 2 is cooled, the base member 2 is cut a measured distance from the last coil 6, and then the fibers 3 are cut from the base member 2 between the last coil 6 and the end 19 of the leader 18.

Figure 8:
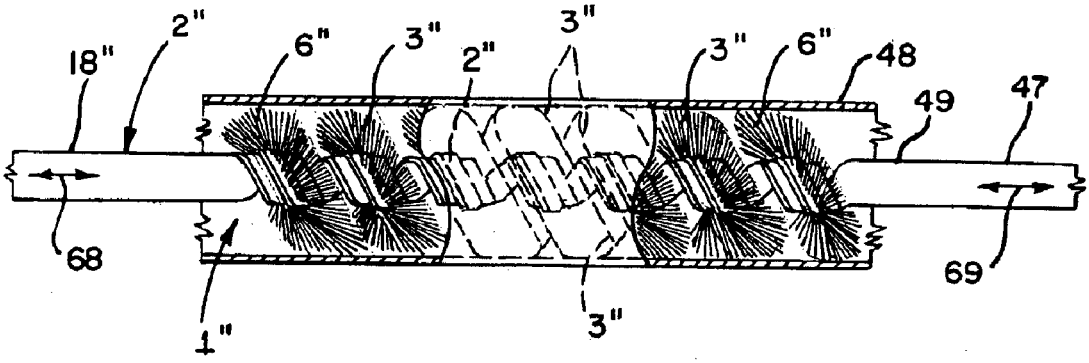
FIG. 8 is a side view of a cleaning device similar to the cleaning device illustrated in FIG. 5 except that a leader member is attached to both ends of the portion with filaments. The cleaning device is illustrated cleaning a tube shown in partial section. The filaments in a portion of the cleaning device have been removed to illustrate the configuration taken by the base member when both ends of the cleaning device are in tension. The drawing illustrates how the cleaning device can be used in a "sawing" motion to clean a tube.

Some special uses of the cleaning device require a leader 18" and a tail piece 47 as shown in FIG. 8. By providing a leader 18" and a tail piece 47 the cleaning device 1" can be inserted through a tubular member 48, pulled further by means of the leader 18" until the body of the cleaning device 1" reaches a predetermined portion of the tube 48 and then the leader 18" and tail piece 47 can be grasped and the cleaning device 1" reciprocated back and forth within the tube 48 as indicated by double arrows 68 and 69. Such procedure is more effective and certainly much quicker in cleaning the tube 48 than repeatedly inserting , pulling the cleaning device 1" completely through the tube 48 and then reinserting the cleaning device 1" in the tube 48.

Very little needs to be done in changing the method of making the cleaning device. One solution is simply to measure a portion of the base member 2 which is to become the tail 47 and simply attaching the base member 2 at the upstream end 49 of the tail 47 to the mandrel 11. After the cleaning device 1 has been formed and cooled, the fibers 3" on coils 6" are simply cut from the base member 2" which forms the tail 47.

Still another form of the cleaning device is constructed from a base member 2 which is formed with different types of fibers 3. Some of the fibers could be soft, for example, and some of the fibers could be relatively more rigid. Still another form of the cleaning device would be to provide the base member 2 with a mixture of different fibers 3 such as cotton fibers and synthetic fibers. Such fibers 3 could be attached to the base member 2 in patterns of uniformly mixed distribution or patterns of segregated blocks of different fibers, or indeed, a mixture of the two types of patterns.

The versatility of using a thermoplastic base member 2 is illustrated by comparing the cleaning devices illustrated in FIGS. 5 and 6. The base member 2 in FIG. 5 is identical in size to the base member 2' in FIG. 6. The cleaning device 1' in FIG. 6 is greater in diameter, however, than the cleaning device 1 illustrated in FIG. 5, by merely providing longer fibers 3. Different diameter cleaning devices using the same base member 2 may also be achieved by winding the base member on different diameter mandrels.

The spacing of coils 6 to each other may be varied in several ways, one of which is shown in FIG. 6. As shown in FIG. 5, the spacing of the coils 6 is very close so that a dense packing of fibers 3 is achieved. This may be accomplished by winding the base member 2 on the mandrel 11 at nearly a right angle so that there is a small space 43 between the helically wound base member 2 upon the mandrel. In contrast, in FIG. 6, there is considerable spacing between each of the coils 6' so that the cleaning device fibers 3' are less densely packed. As shown in FIG. 6, there is a substantial distance 43' between each coil 6'. This is generally accomplished by moving the carriage 24 at a greater velocity. Cleaning device 1' in FIG. 6 may be formed with a leader 18' adjacent lead coil 27'.

FIGS. 4 and 5 also illustrate that the slope of the coils 6 may be varied even though the exact same base 2 is used and the fibers 3 are attached in the same manner. Note that the coils 6 make almost a right angle with the axis 29 of the cleaning device 1 whereas the coils 6' in FIG. 6 make a greater angle 5' with the axis 29'. This is accomplished by either changing the velocity of the carriage 24 as previously described, or actually feeding the base 2 onto mandrel 11 at a different angel 21 as shown in FIG. 3.

Uses for the Cleaning Device of the Present Invention

Figure 9:
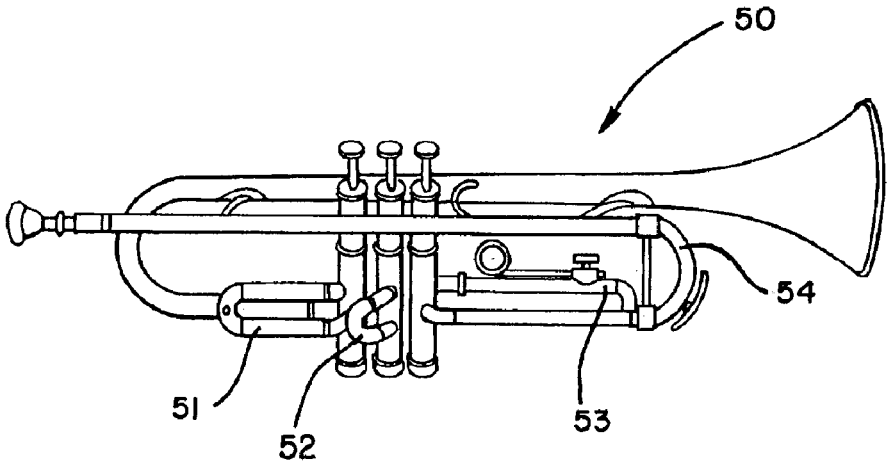
FIG. 9 is a schematic drawing of a trumpet illustrating four removable slides which may be cleaned by the cleaning device of the present invention.

The cleaning device of the present invention was initially invented to provide a cleaning device for musicians playing brass instruments to clean their instruments. A trumpet 50 for example , as shown in FIG. 9 has four valve slides: a first slide 51, a second slide 52, a third slide 53 and a tuning slide 54; all of which must be removed from the instrument and regularly cleaned. The cleaning device of the present invention has been found to be ideal since is able to be inserted and pulled through all of the trumpet valve slides which are small in diameter and have very tight right turns. Since the cleaning device is entirely made of plastic, there are no metal wires to scrape the inside walls of the slide valves, or poke a hole in weak or old brass musical instruments. The cleaning device, itself is easily cleaned after each use. The cleaning device is light, rolls up into a tight spiral and returns instantly and automatically to a straight configuration ready for use. The entire cleaning device being made from plastic dries quickly and with no metal parts, it requires no expensive water proof sheathing and will not rust or contaminate the instrument or tubing it is cleaning.

The cleaning device of the present invention is not limited to musical instruments and can be used to clean glass or plastic tubing used in chemistry labs. In fact the cleaning device can be used commercially or in homes for a wide variety of devices and apparatus which have tubes or constricted openings, which must be cleaned from time to time.

Operation of the Helical Device

Referring to FIG. 7, a cleaning device 1 such as the device illustrated in FIG. 5 may be used to clean a tube 45 such as a metal or glass tube. The cleaning device 1 may be used either with a cleaning solvent, with soap and water, or by itself. Using it with water helps flush the tubing during the cleaning process. Tube 45 could be a portion of any tube as for example one of the slides 51–54 of a trumpet 50 illustrated in FIG. 9. To clean the tube, leader 18 is first inserted through end 55 until it emerges through end 56. As illustrated in FIG. 7, as the cleaning device 1 is pulled through the tube 45 in the direction indicated by arrow 57 the coils 6 at the tail end of the cleaning device 1 in the straight portion of the tube 45 indicated by the arrow 58 remain in substantially their original spacing one from another. As the cleaning device moves around curved portion 46, the pulling force on the base member 2 must be increased because of the friction of the fibers 3 against the sides of the curved portion. This additional resistance to movement of the cleaning device 1 causes the helical base member 2 to stretch and cause greater spacing to occur between each of the helical coils 6 as indicated by the arrows 59. As demonstrated in FIG. 6, when the spacing between coils open up and becomes greater, the effective diameter of the coils 6 is reduced by the fact that the slope of the coils is increased and the diameter of the core opening is decreased as illustrated in FIG. 6. Because the effective diameter of the coils is reduced, the friction that the ends of the fibers 3 exert on the inside wall 60 of the tube 45 is reduced. This makes it easier to pull the cleaning device 1 through the tube. After all of the cleaning device 1 has traversed the curved portion 46 of the tube, the friction of the cleaning device 1 against the walls 60 is reduced, and the distance between coils is reduced thus causing the coils to once again exert a greater force on the wall 60. As the coils emerge from end 56 of the tube such as coil 76, as shown in illustration FIG. 7, because of the memory of the fibers 3 and the base 1, the coils 6 grow in diameter.

A similar stretching of the base occurs where there is a constriction in the tube.

Alternate Form and Method of the Cleaning Device

Figure 10:
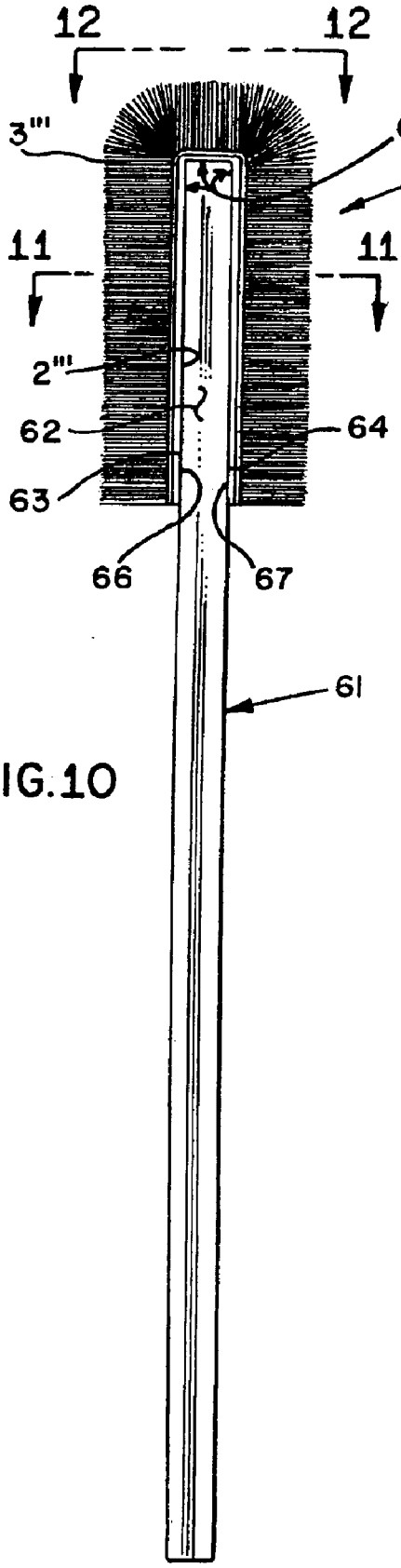
FIG. 10 is a side view of another form of the invention.
Figure 11:
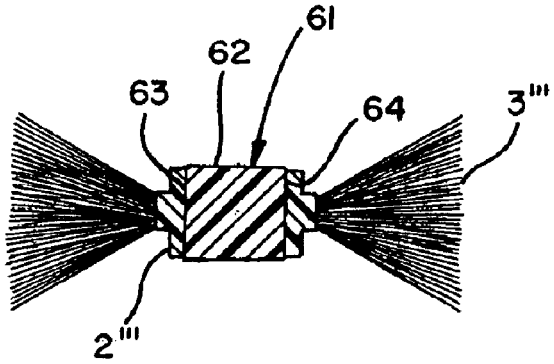
FIG. 11 is an enlarged scale cross sectional view of the device shown in FIG. 10 taken along line 11—11.
Figure 12:
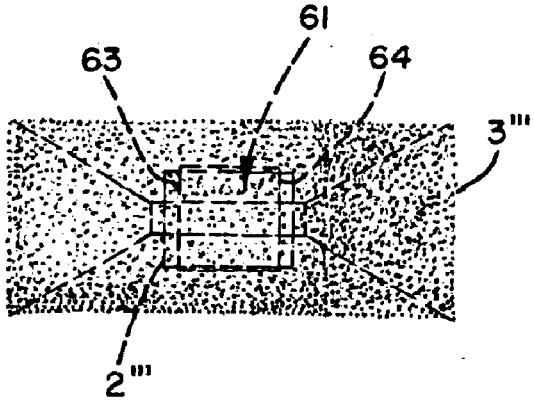
FIG. 12 is an enlarged scale end view of the device shown in FIG. 10 taken in the direction of line 12—12.

Referring to FIGS. 10, 11 and 12, an alternate form of the cleaning device 1''' is illustrated. Cleaning device 1''' is formed from the same base 2 and fibers 3 as illustrated in FIG. 4; both of which are made from a polypropylene thermal plastic. Cleaning device 1''' consists of a holder member 61 having an end portion 62 configured to provide angularly related sides 63 and 64; a base member 2''' formed from a thermoplastic material; a plurality of fibers 3''' integrally connected to the base member 2''' and protruding therefrom; and the base member 2''' is configured to overlap the end portion 62 and to register with the angularly related sides 63 and 64 so that the fibers protrude outwardly from the base member 2''' and the holder member 61. Holder member 61 may be round or polygonal such as a square and the angularly related sides may be curvilinear, flat or multifaceted so long as the faces 63 and 64 are angular one to the other.

Only one strip of base member 2''' has been attached to the holder member 61, but two or more base members with fibers could be used to provide additional fibers. The holder member could be straight or curvilinear depending upon the particular cleaning purpose of the cleaning device.

Preferably the thermoplastic base 2''' should be heated at least in the U-shaped portion 65 and the memory of the material reset so that the entire base member 2''' can be more easily affixed to the holder member 61.

The base member 2''' may be attached to the end portion 62 of the holder 61 by any mechanical means such as taping, or by applying adhesive, but preferably by a method set forth below.

No drawings are believed necessary for an understanding of the method used to make the cleaning device illustrated in FIGS. 10–12 in view of the extensive illustrations of the method of forming a helical cleaning device as shown in FIGS. 1–3.

The method for forming a cleaning device 1''' includes the steps of: selecting an elongated base member 2''' formed from a thermoplastic material such as polypropylene and having a plurality of fibers 3''' integrally connected thereto and protruding therefrom; bending the elongated base member 2''' in a U-shape-like configuration forming a head portion 65 and depending leg portions 66 and 67; heating the thermoplastic material sufficiently to reset the memory of the thermoplastic material to the U-shape-like configuration; and attaching the leg portions 66 and 67 to a holder member 61.

Using the method above described, the legs 66 and 67 may be attached to the holder 61 by tape or other mechanical means, but the preferred method is to attach the entire base member 2''' by the method set forth below.

Another method for forming a cleaning device 1''' which comprises the steps of: selecting a holder member 61 having an end portion 62 formed from a thermoplastic material; selecting an elongated base member 2''' formed from a thermoplastic material and having a plurality of fibers 3''' integrally connected thereto and protruding therefrom; bending the elongated base member 2''' in a U-shape-like configuration forming a head portion 65 and depending leg portions 66 and 67; and heating the thermoplastic portion 62; and elongated base member 2''' sufficiently to reset the memory of the thermoplastic base member 2''' to the U-shape-like configuration and to fuse at least a portion of the elongated base member 2''' to at least a portion of the thermoplastic portion of the holder member 61.

In summary, the cleaning device of the present invention may be configured to almost any geometric or random configuration by heating a strip of thermoplastic material, bending the strip to the desired shape and then cooling the material. The U-shape-like and helical-like configurations are only illustrative of two of the shapes envisioned by applicant.

The configuring of the cleaning device to a large extent determines the use to which the device may be put. Again, cleaning the tubes in brass instruments, the glass ware in chemistry labs and common housewares is only illustrative of the unlimited uses to which cleaning devices, commonly called brushes have been employed.

Alternate Forms Illustrated in FIGS. 13–27

FIGS. 13 through 27 illustrate several alternative forms of the invention, all of which are based on the cleaning device previously described. All of the alternate forms use the same base member, the same helix-like configuration and the same fibers. All of these elements are made from the same plastic materials and all are constructed using the same methods set forth above.

All of the alternative forms of the invention illustrated in FIGS. 13–27 contain one additional element; viz. a plastic core member to which the base member is attached at one or more points or even continuously attached.

The materials and method of construction will not be further described because it would simply be a duplication. Like elements are numbered the same except that they are distinguished by a 100 series number designator.

For ease in following the description, each figure from 13 through 27 will be described in consecutive order.

Figure 13:
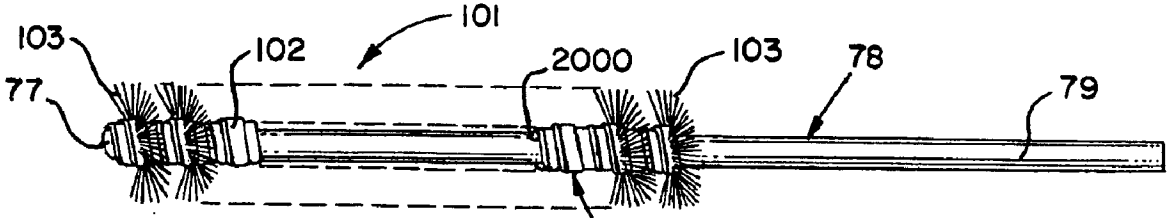
FIG. 13 is side view of an alternate form of the device in which the base member is attached to a core member. The core member is extended at one end providing a convenient handle for pushing and pulling the device through a tubular member. Portions of the base and fibers are omitted as a convenience to the illustrator in hand drawing the figure. The omitted portions are indicated by dashed lines. This same "short hand" convenience is also shown in other drawings in this set of drawings, and the explanation is not repeated.
Figure 14:
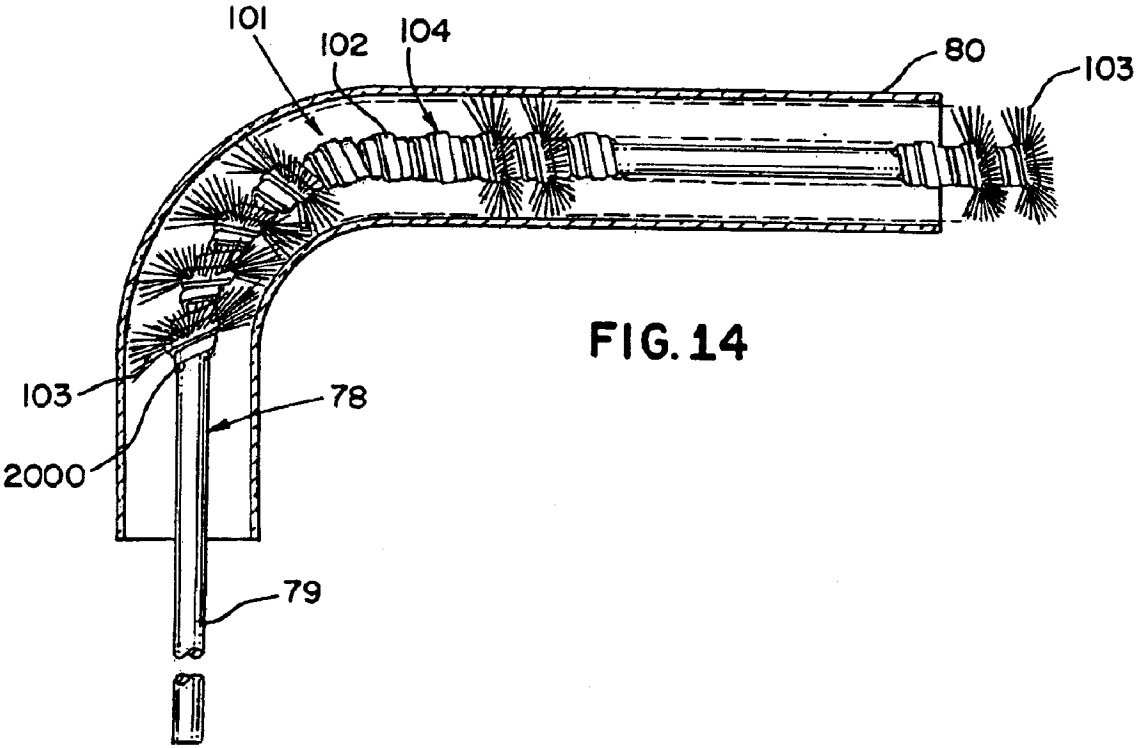
FIG. 14 is a side view of the device illustrated in FIG. 13 with the device being pushed through a tubular member having a right angle bend. The fibers are relatively short so that the cleaning device may reach all portions of the inside walls of a relatively small diameter work piece. Fibers have been removed from the cleaning device in the portion where the device is at a bend in the tubular member to more clearly illustrate the bending that occurs in the base and core members. The fibers in FIGS. 13 and 14 are less dense which generally, but not always, indicates that the fibers are relatively rigid.

The cleaning device 101 in FIGS. 13 and 14 includes an elongated flexible base member 102 formed from a thermoplastic material and formed in a helix-like configuration 104 forming an opening 77 therethrough. The base member 102 has a characteristic permitting memory reset from a first configuration to a second configuration upon the application of heat and cold. A non-stretchable and relatively non-compressible plastic core member 78 is inserted through the opening 77 and attached to the base member at one or more points or even continuously. The plastic core member may be constructed from a polypropylene or other plastics which may be easily attached to the base member 102. Preferably the material may be attached by thermal welding.

The core member 78 is extended at one end beyond the base member 102 providing a convenient handle 79. The handle may be of various lengths from a few inches to several feet for cleaning boiler tubes or other long tubes. The fibers 103 are relatively short so that the cleaning device may fit through and clean a relatively small diameter tube. The fibers 103 may be relatively stiff or relatively flexible depending upon the usage of the cleaning device. The device as illustrated has a smaller number of fibers attached to the base member providing a relatively less dense array of fibers. As may be seen in FIG. 14, the cleaning device may be inserted into tube 80 by pushing on handle 79, and then withdrawing the device by pulling on the handle. In a a device as shown, the base member 102 is preferable continuously connected to the core member 78.

Figure 15:
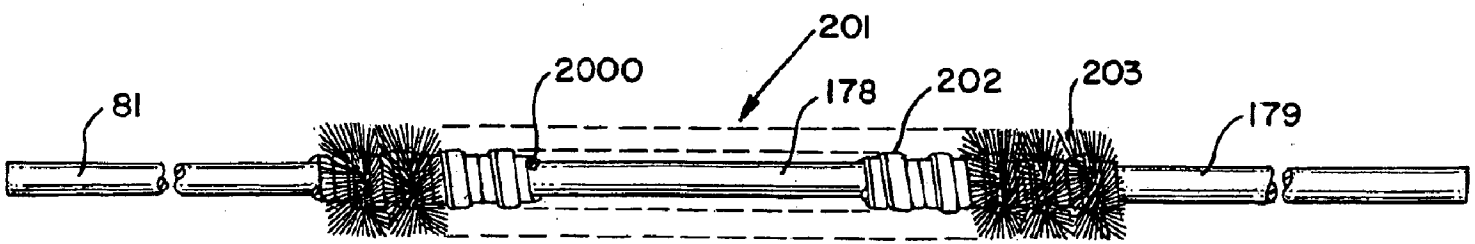
FIG. 15 is another alternate form illustrating a cleaning device with a base and a core with core extensions at both ends forming two handles permitting pushing of the cleaning device from either end and also permitting the device to be reciprocally moved as in a "sawing" action. Note that the fibers In FIGS. 15 17 are more dense than the fibers in FIGS. 13 and 14.
Figure 16:
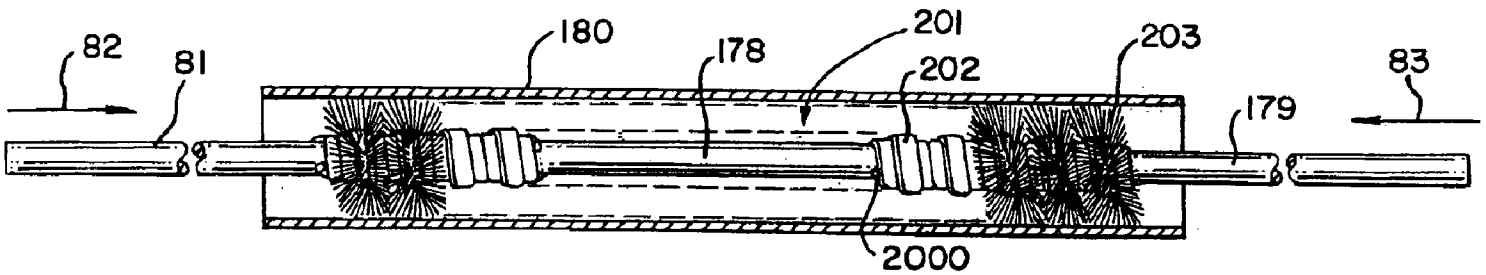
FIG. 16 is another side view of the device illustrated in FIG. 15 inserted in an open ended tubular member. The arrows indicate that the cleaning device may be pushed at either end in the direction of the arrows.

FIGS. 15 and 16 illustrate another form of cleaning device 201 constructed similarly to the cleaning device in FIGS. 13 and 14 but with the following differences. The core member 178 of cleaning device 201 is extended on one end to form handle 179, and extended on the other end to form handle 81. The provision of two handles permits the cleaning device to be easily moved back and forth in a sawing like action to effect cleaning. The cleaning device may be pushed in either direction as illustrated by arrows 82 and 83 through a tube 180. The core member 178 may be attached to the base member 202 at one or more points and preferably in this form of the invention the connection is continuous. Note that fibers 203 are relatively short, but compared to fibers 103 in FIGS. 13 and 14, the number of fibers are greatly increased and densely packed.

Figure 17:
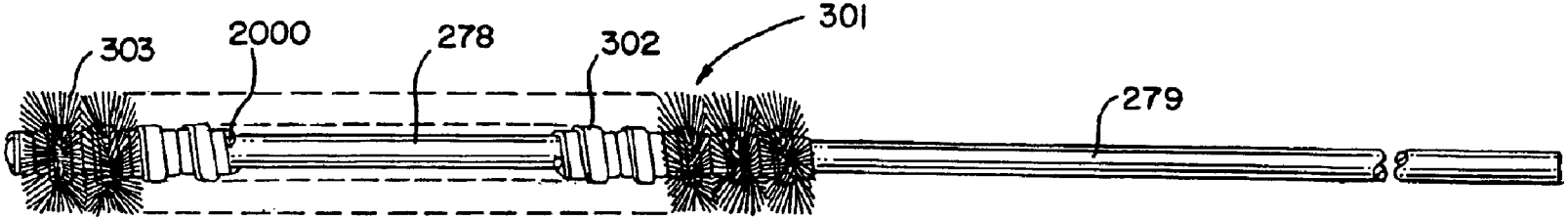
FIG. 17 is another alternate form of the invention similar to the device in FIGS. 15 and 16, but with only a single handle.

FIG. 17 illustrates a cleaning device 301 similar to the cleaning device 201 in FIGS. 15 and 16, but with only a single handle 279. Base member 302 is connected to core member 278 at one or more points or even continuously. Fibers 303 are connected to base member 302.

Figure 18:
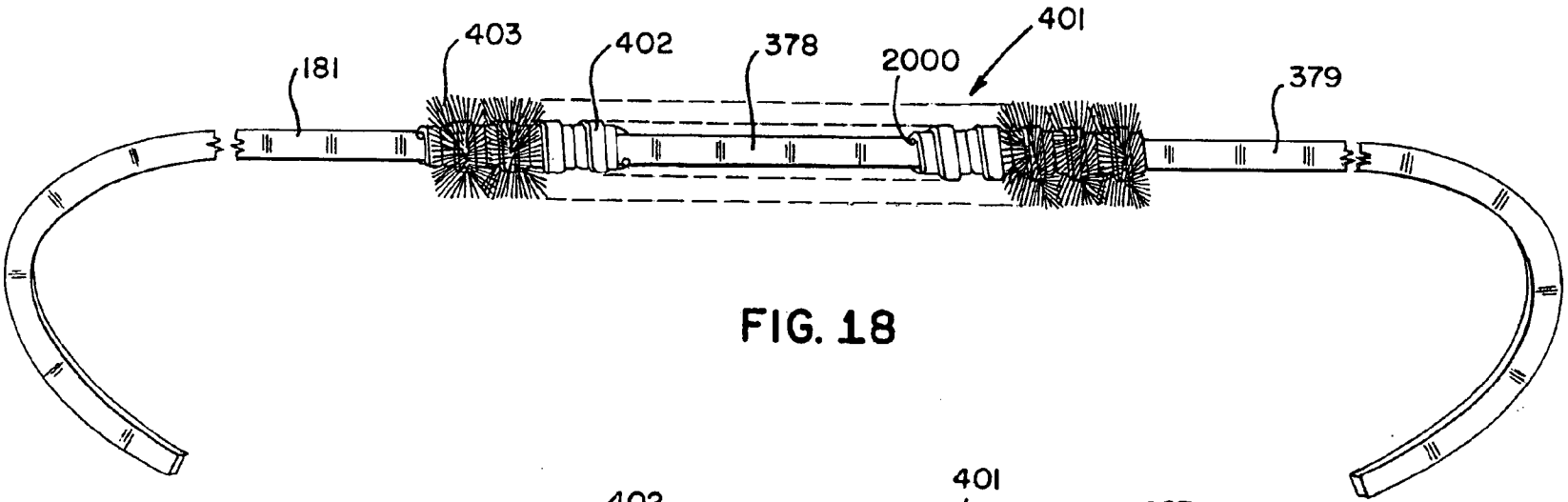
FIG. 18 illustrates still another form of the invention in which the base member is attached to a core member which is relatively flexible. The device can be used in tubular members which have a tortuous configuration with bends having a relatively small radius. The core member, however, is more subject to buckling and is generally unsuitable for insertions by pushing. The device will normally have leaders at both ends as illustrated.

FIG. 18 illustrates cleaning device 401 which is still another form of the invention in which the base member 402 is attached to a core member 378 which is relatively flexible. The device can be used in tubular members which have a tortuous configuration with bends having a relatively small radius. The core member 378, however, is more subject to buckling and is generally unsuitable for insertions by pushing. The device will normally have leaders or handles 379 and 181 at both ends formed as extensions of the core member 378 as illustrated. Fibers 403 have the same length , rigidity, and density as the fibers 203 in FIGS. 15 and 16, but as previously stated, the cleaning device 401 illustrated in FIGS. 18 and 19 may have fibers of different rigidity, density, and length from the cleaning device 201 illustrated in FIGS. 15 and 16.

Figure 19:
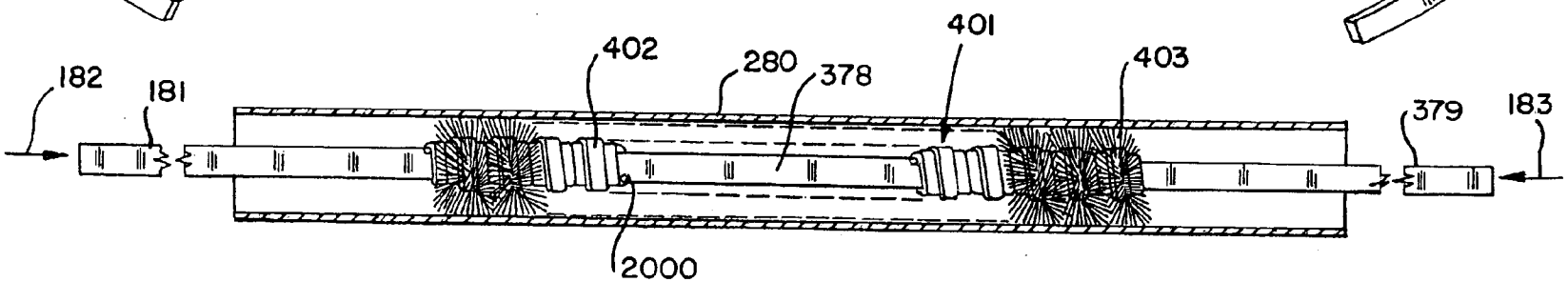
FIG. 19 illustrates the same cleaning device as illustrated in FIG. 18 being applied to an open ended tube. The arrows indicate that the cleaning device may be pulled in both directions. They do not necessarily indicate that the device may be pushed through the open ended tube. In most instances the core would buckle if simply pushed.

FIG. 19 illustrates the same cleaning device as illustrated in FIG. 18 being applied to an open ended tube 280. The arrows 182 and 183 indicate that the cleaning device may be pulled in both directions. They do not necessarily indicate that the device may be pushed through the open ended tube. In most instances the core 378 and handles 181 and 379 would buckle if simply pushed.

Figure 20:
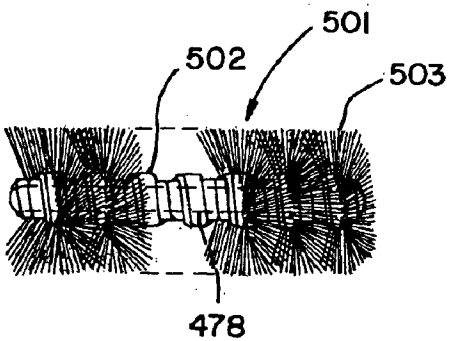
FIG. 20 illustrates a variation of the brushes illustrated in FIGS. 13–15. The cleaning device is formed with a base, as well as a core and is relatively short. The fibers are relatively dense.
Figure 21:
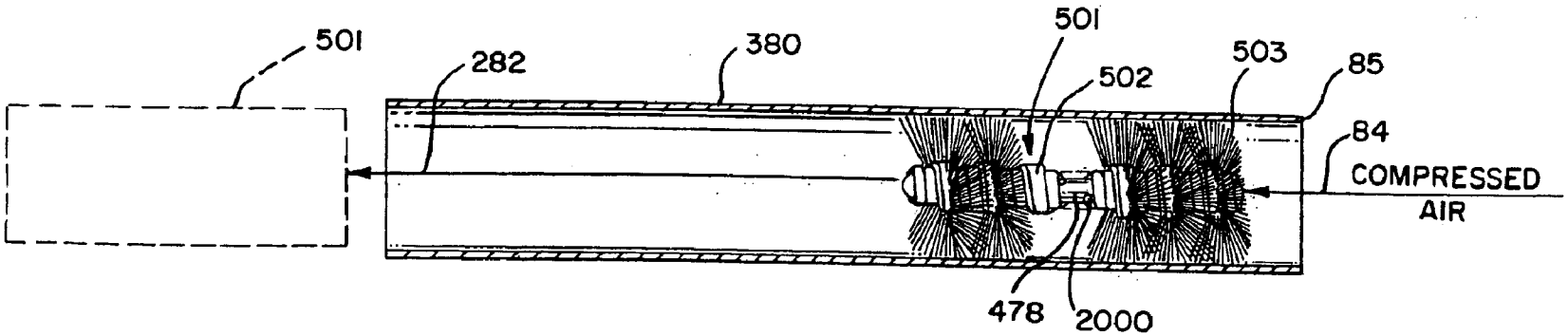
FIG. 21 is a side view of the cleaning device illustrated in FIG. 20 with portions of the base removed to reveal the core beneath. The cleaning device is shown in one application being propelled through an open ended tube by compressed air or any fluid under pressure. The dashed figure at the left side illustrates the cleaning device exiting the open ended tube. Various pressures applied to the upstream end of the tube can vary the speed at which the cleaning device traverses the tube.

FIG. 20 illustrates a variation of the cleaning devices illustrated in FIGS. 13–15. The cleaning device 501 illustrated in FIGS. 20 and 21 is formed with a base 502, as well as a core 478 and the overall length may be relatively short. The fibers 503 are relatively dense to provide back pressure when the cleaning device 501 is driven by fluid pressure as discussed below. No leader or handles are generally formed in this form of the invention.

FIG. 21 is a side view of the cleaning device 501 illustrated in FIG. 20 with portions of the base removed to reveal the core 478 beneath. The cleaning device 501 is shown in one application being propelled through an open ended tube 380 by compressed air or any fluid under pressure, indicated by arrow 84 in the direction shown by arrow 282. The dashed figure at the left side illustrates the cleaning device 501 exiting the open ended tube 380. Various pressures applied to the upstream end 85 of the tube 380 can vary the speed at which the cleaning device traverses the tube.

Figures 22, 23:
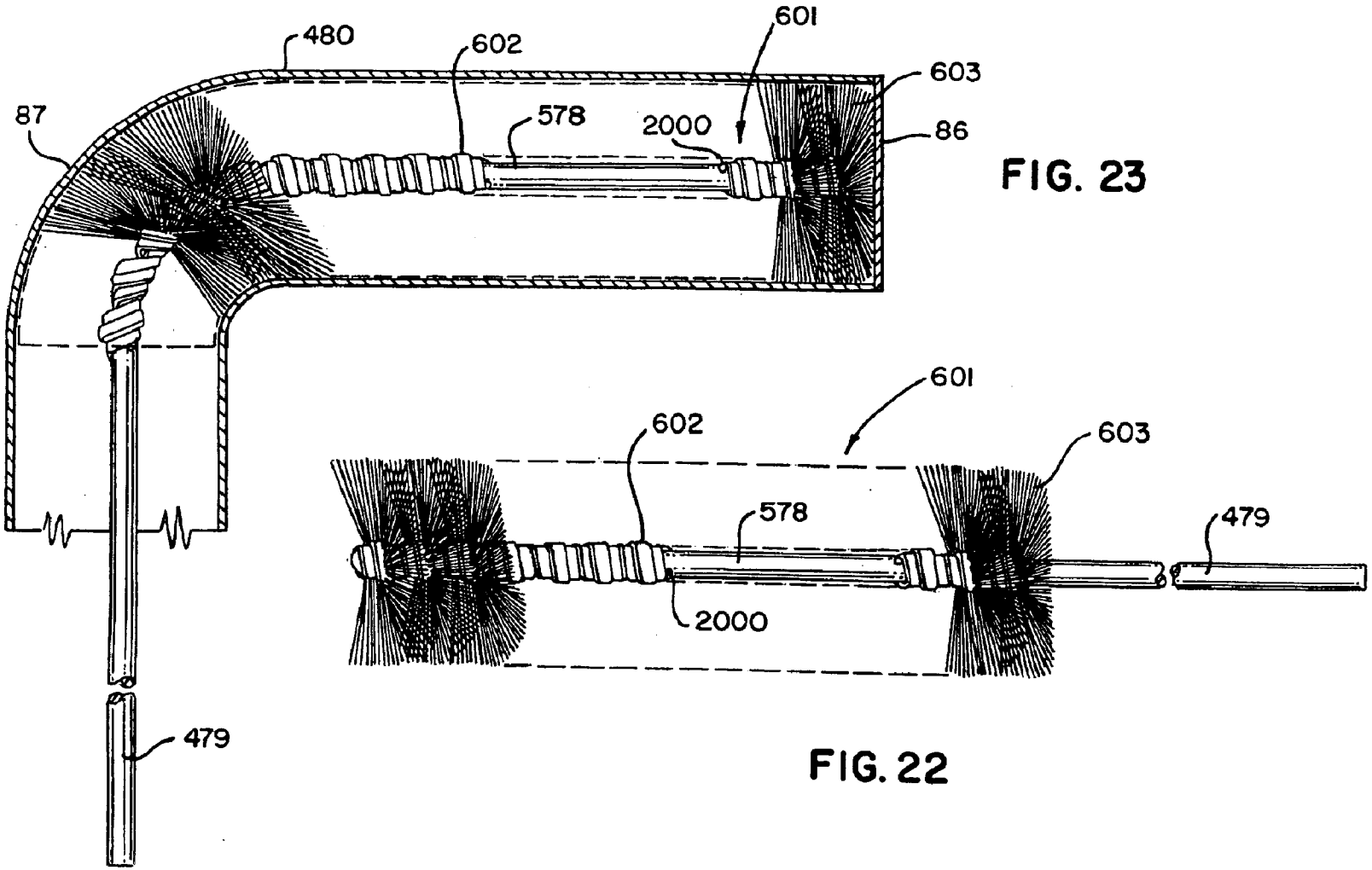
FIG. 22 is another form of the cleaning device illustrated in FIG. 13. A portion of the fibers have been removed to more clearly reveal the helix-like base member and a portion of the base has been removed to more clearly reveal the core member. As compared with FIG. 13, the fibers are relatively longer and relatively more dense to illustrate that the same base and core member can be used to make cleaning devices capable of cleaning devices of larger diameter. It also illustrates that that the cleaning device may be used with less rigid fibers. The length, rigidity, and density of the fibers may be varied according to the use of the brush and the objects to be cleaned.
FIG. 23 illustrates a cleaning device as shown in FIG. 22 being used in a work piece having an open end and a closed end. A right angle bend is shown at the end of the work member.

FIGS. 22 and 23 illustrate cleaning device 601 which is another form of the cleaning device 101 illustrated in FIG. 13 and the cleaning device 301 illustrated in FIG. 17. A portion of the fibers 603 have been removed to more clearly reveal the helix-like base member 602 and a portion of the base 602 has been removed to more clearly reveal the core member 578. As compared with FIG. 13, the fibers are relatively longer and relatively more dense to illustrate that the same base and core member can be used to make cleaning devices capable of cleaning devices of larger diameter. It also illustrates that that the cleaning device may be made with longer and less rigid fibers. The length, rigidity, and density of the fibers may be varied according to the use of the brush and the objects to be cleaned. Cleaning device 601 is formed with a single handle 479 which is an extension of core member 578. Cleaning device 601 could also be formed with a second handle if the other end of core member 578 was extended. With a second handle, however, cleaning device 601 could not be used in cleaning closed end tubes.

FIG. 23 illustrates cleaning device 601 being used in a work piece such as a tubular member 480 having an open end (not shown) and a closed end 86. A right angle bend 87 is shown near the end of the work member or tube. Handle 479 has sufficient rigidity and resistance to buckling so that the cleaning device may be pushed into a tubular member 480 with a closed end 86 and even with a right angle bend 87 near its end.

Figure 24:
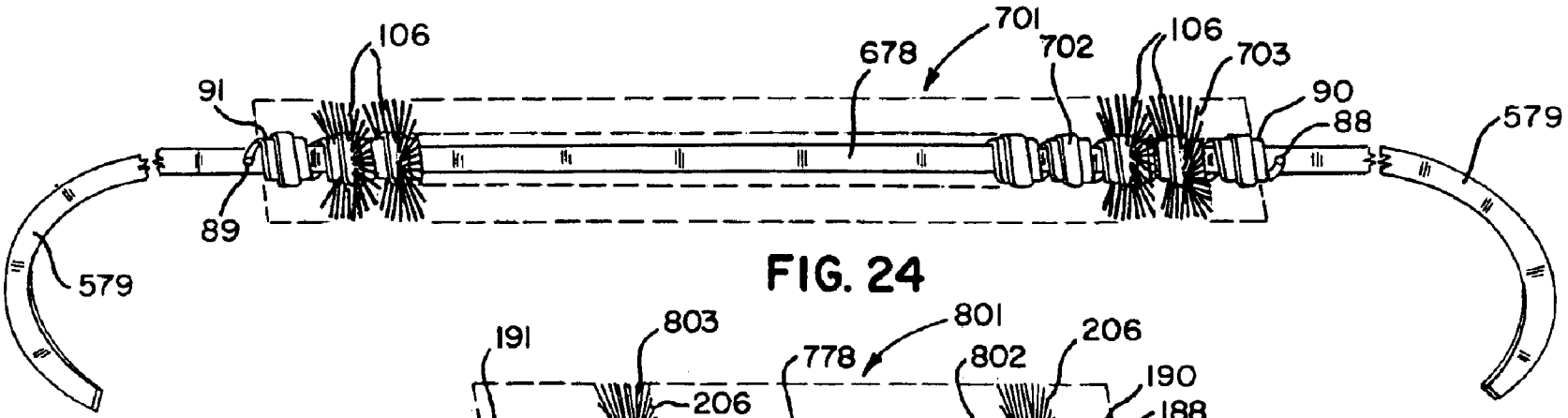
FIG. 24 illustrates another variation of the cleaning device illustrated in FIG. 18. In this illustration, the helix like base is attached at only two points to the core member; viz. at the ends of the base member only.

FIG. 24 illustrates a cleaning device 701 which is another variation of the cleaning device 401 illustrated in FIG. 18. In this illustration, the helix-like base 702 is attached at only two points 88 and 89 to the core member 678; viz. at the ends 90 and 91 of the base member 702. Because attachment at two end points would permit bunching of the base member 702, it is believed preferable in most instances to attach the base member 702 to the core member 678 at several spaced points to limit the amount of bunching of the base member 702. Fibers 703 are less dense than the cleaning device 401 illustrated in FIG. 18 and may be more rigid than fibers 403 in FIG. 18. All coils 106 are free to slide along core 678 as helix-like base 702 stretches and contracts depending on the direction of pull on handles 579 and drag caused by foreign matter adhering to the walls of tubular member members through which he cleaning device 701 is drawn.

Figure 25:
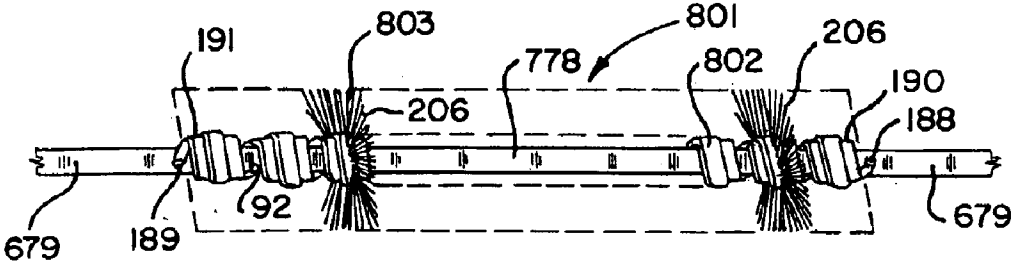
FIG. 25 is another form of the brush illustrated in FIG. 24 in which the base member is attached to the core member at one end of the base member and at another point inwardly from the other end of the base member.

FIG. 25 illustrates cleaning device 801 which is another form of cleaning device 701 illustrated in FIG. 24 in which base member is attached to the core member 778 at points 188 and 189 at ends 190 and 191 of the base member 802 and at another point 92 inwardly from end 191 of the base member 802. It is to be understood that the illustrated attachment points 188, 189 and 92 are illustrative only and as previously stated, all of the bases of the cleaning devices in FIGS. 13 through 27 may be attached to the core member at one or more points or continuously. At this point in time, Applicant has not had the opportunity to test all of the attachment point patterns that are possible and that would give the best results for different cleaning devices of different lengths, varying core members, varying fiber rigidity and length, and various densities of fibers. Note that in FIG. 25, fibers 803 have lengths about the same as fiber lengths 703 in FIG. 24, but are more dense. Handles 679 which are extensions of core member 778 are provided at both ends of the core member 778.

Figure 26:
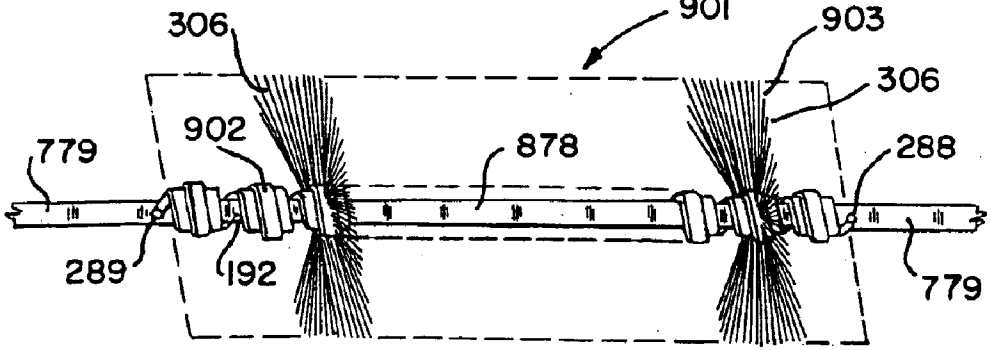
FIG. 26 is still another form of the brush illustrated in FIG. 25 in which the fibers are longer. It should be noted that the helix-like base member may be attached continuously, at one point, or multiple points on cores which are flexible or relatively rigid and free of buckling.

FIG. 26 shows a cleaning device 901 which is still another form of cleaning device 801 illustrated in FIG. 25 in which the fibers 903 are longer. It should be noted that the helix-like base member 902 may be attached continuously, at one point, or multiple points on bases which are flexible or relatively rigid and free of buckling. As illustrated, base member 902 is attached at attachment points 289, 192 and 288 to core member 878. Note that even though the base member 602 in FIG. 22 is about the same length as the base member 902 in FIG. 26, the diameter of coil 306 in FIG. 26 is much greater than coil 206 in FIG. 25. Cleaning device 901 is formed with handles 779 which are extensions of core member 878.

Figure 27:
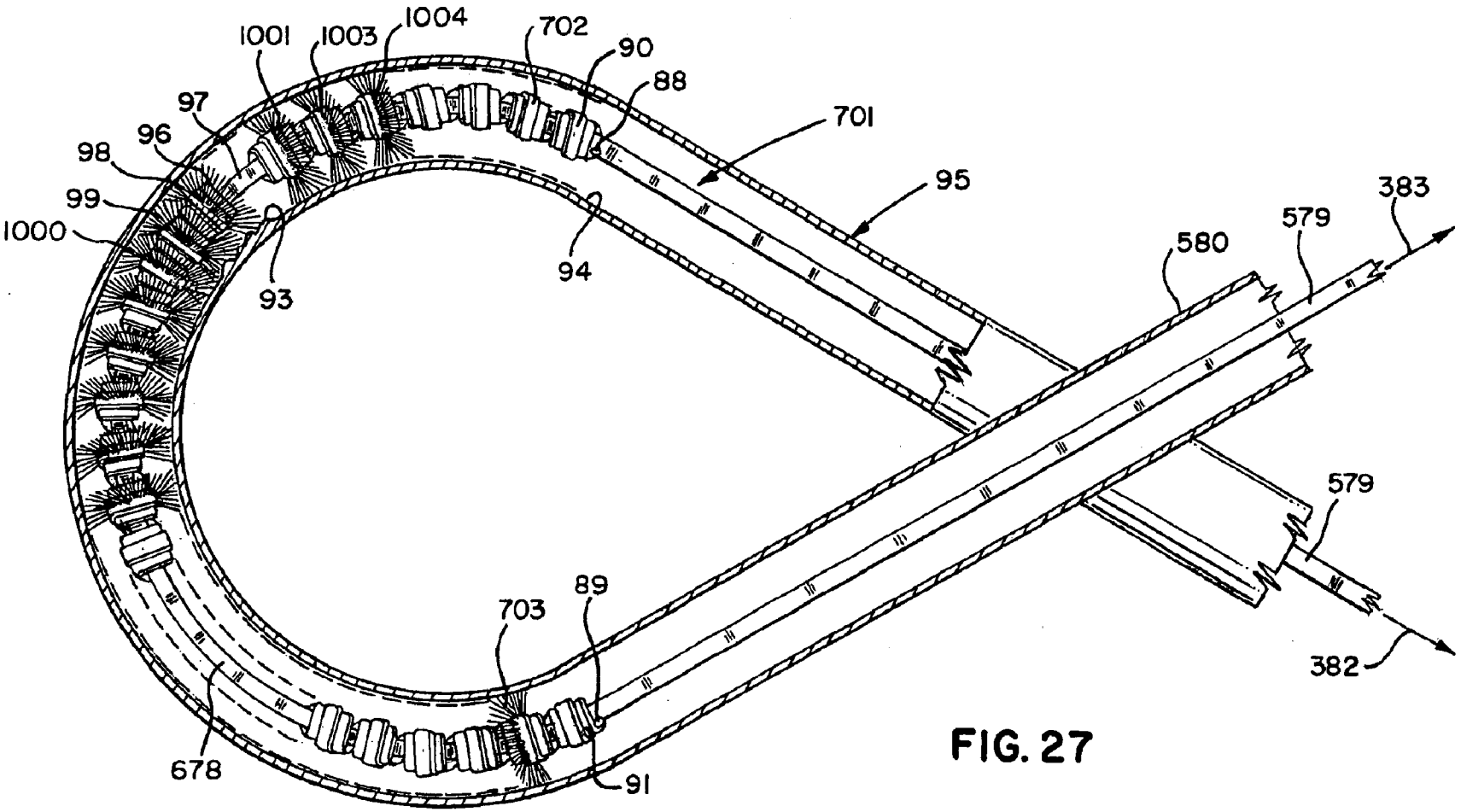
FIG. 27 illustrates a cleaning device constructed with a core which is relatively flexible , with the helix-like base configuration attached to the core at two end points of the base. The cleaning device may be pulled in both directions, but in the illustration is being pulled in the direction of the lower arrow in the illustration. A protrusion is shown on one side of the inner wall illustrating a dirt or corroded section. The base is not attached to the core at the incidence of the protrusion thus causing the base to slide on the core and causing the base to stretch on the pulling side and to bunch up at the point of the protrusion.

FIG. 27 illustrates one use of cleaning device 701 illustrated in FIG. 24. As previously stated core member 678 is relatively flexible , with the helix-like base configuration 702 attached to the core 678 at two attachment points 88 and 89 at end 90 and 91 of the base member 702. The cleaning device 701 may be pulled in both directions as shown by arrows 382 and 383, but in the illustration is being pulled in the direction of arrow 382 in FIG. 27. A protrusion 93 is shown on one side of the inner wall 94 of a complete loop section 95 of a tubular member 580 illustrating a dirt or corroded section. The base portion 96 of base 702 is not attached to core section 97 of the core member 678 at the incidence of the protrusion 93 thus causing several coils 98, 99, and 1000 of the base member 702 to slide on the core 678 and causing the base member 702 to stretch on the pulling side and to bunch up at the point of the protrusion 93. As continued pulling on core member 678 as indicated by arrow 382 occurs, coils 98, 99, and 1000 will in turn rub over protrusion 93 and reduce the size of protrusion 93. Until all of the coils of the cleaning device 701 pass the protrusion 93 or until the protrusion 93 is completely removed, the base member 702 will stretch and cause a separation of the coils as shown by coils 1001, 1003, and 1004.

Of course, if base member 702 was continuously attached to core member 678, no stretching of the base member 702 would occur and no separation between the coil members would occur. Continuous attachment of the base member to the core member is indicated by the number 2000 in FIGS. 13–19, and 21–23. The forms of the invention shown with continuous attachment of the base member to the core member could also be attached only at one or more separate points.

In the case of attachment of the base member 702 at intervals along the length of the base member 702 to core member 678, isolated stretching would occur and bunching of the coils would occur at dispersed segments along the length of the base member.

I claim:

1. A cleaning device comprising:

a. an elongated flexible base member formed in a thermally set helix-like elongated coiled configuration stretchable and bendable from a first contracted coiled position to a second extended coiled position therein forming a varying diameter opening therethrough and forming a varying helical angle and formed from a thermoplastic material having fibers protruding from at least one side of a portion thereof and said base member having a characteristic permitting thermal memory reset from an initial first configuration to a second configuration; and b. said base member in said helix-like coiled configuration having a characteristic of memory spring return from said second extended coiled position to said first contracted coiled position.

2. A cleaning device as described in claim 1 wherein:

a. said base member having an elongated helix-like coiled configuration has a constant helical angle.

3. A cleaning device as described in claim 1 wherein:

a. said base member has an elongated flexible helix-like configuration having a helical angle which may be initially selectively varied along its length.

4. A cleaning device as described in claim 1 wherein:

a. said base member has an elongated helix-like coiled configuration having a selected helical angle which forms a device wherein said individual helix-like coils are close fitting one to the other.

5. A cleaning device as described in claim 1 wherein:

a. said base member has an elongated helix-like coiled configuration having a selected helical angle which forms a device with coils which are spaced one from the other a selected distance.

6. A cleaning device as described in claim 1 wherein:

a. said fibers protrude from said base at varying selected lengths from said base.

7. A cleaning device as described in claim 1 wherein:

a. said base member has an elongated flexible helix-like configuration initially having portions with different selected helical angles.

8. A cleaning device as described in claim 1 comprising:

a. a non-stretchable, flexible and relatively non-compressible plastic core member inserted through a portion of said opening formed by said elongated flexible base member formed in a thermally set helix-like elongated coil configuration and connected to said flexible base member formed in a thermally set helix-like elongated coil configuration at one or more points along the length of said plastic core member; and b. said thermally set helix-like elongated coiled flexible base member having the freedom to stretch and bend and slide along said plastic core member from all of said plastic core member connection points and between all of said plastic core member connection points.

9. A cleaning device as described in claim 8 comprising:

a. a first core extension extending beyond a first end of said flexible base member forming a first handle.

10. A cleaning device as described in claim 9 comprising:

a. a second core extension extending beyond a second end of said flexible base member forming a second handle.

11. A cleaning device as described in claim 8 comprising:

a. said core member is shaped and dimensioned to permit said device to be inserted through elongated enclosures without buckling.

12. A cleaning device as described in claim 11 comprising:

a. said fibers are of sufficient density and length to permit said cleaning device to be forced though a structure to be inserted through a tubular structure by fluid pressure.

13. A cleaning device as described in claim 8 comprising:

a. said core member is shaped and dimensioned to permit said device to be pulled through elongated tortuous enclosures.

14. A cleaning device as described in claim 8 comprising:

a. said fibers protruding from said base member have a relatively short length to enable said device to be inserted through tubular members having a relatively small cross section.

15. A cleaning device as described in claim 8 comprising:

a. said fibers protruding from said base member have a relatively long length to enable said device to be inserted through tubular members having a relatively large cross section.

16. A cleaning device as described in claim 8 comprising:

a. said fibers protruding from said base member are relatively rigid to enable forceful cleaning of tubular and non tubular work pieces.

17. A cleaning device as described in claim 8 comprising:

a. said fibers protruding from said base member are relatively flexible to enable said device to clean irregularly dimensioned tubular and non-tubular members more effectively or to avoid scratching certain surfaces.

18. A cleaning device as described in claim 1 having no metal parts comprising:

a. a non-stretchable and relatively non-compressible plastic core member having a first portion forming a handle and a second portion inserted through said opening formed by said elongated flexible base member formed in a thermally set helix-like elongated coil configuration;

b. said flexible base member having edges and a base is connected as by bonding substantially continuously at said base to said plastic core member throughout said portion which is formed in a helix-like configuration; and c. said edges of said elongated flexible base member coils are coiled about said plastic core member in close or touching contact with one another so as to stiffen said plastic core member portion in contact with said coiled base member.

19. A cleaning device comprising:

a. an elongated flexible base member formed in a helix-like configuration forming an opening therethrough and formed from a thermoplastic material having fibers protruding from at least one side of a portion thereof and said base member having a characteristic permitting memory reset from a first configuration to a second configuration; and b. a first portion of said elongated flexible base member forming a first end is formed without said helix-like configuration and without said fibers thereby creating a first leader.

20. A cleaning device comprising:

a. an elongated flexible base member formed in a helix-like configuration forming an opening therethrough and formed from a thermoplastic material having fibers protruding from at least one side of a Portion thereof and said base member having a characteristic permitting memory reset from a first configuration to a second configuration;

b. a first portion of said elongated flexible base member forming a first end is formed without said helix-like configuration and without said fibers thereby creating a first leader; and c. a second portion of said elongated flexible base member forming a second end is formed without said helix-like configuration and without said fibers creating a second leader.

21. A cleaning device comprising:

a. an elongated flexible base member formed in a helix-like configuration forming an opening therethrough and formed from a thermoplastic material having fibers protruding from at least one side of a portion thereof and said base member having a characteristic permitting memory reset from a first configuration to a second configuration;

b. a non-stretchable and relatively non-compressible plastic core member inserted through a portion of said opening formed by said elongated flexible base member; and c. said flexible base member is connected to said core member at the end portions only of said flexible base member.

* * * * *